US006151898A

United States Patent [19]

Hogan

[11] Patent Number: 6,151,898

[45] Date of Patent: Nov. 28, 2000

[54] FUEL INJECTOR

[75] Inventor: David A Hogan, Bristol, United Kingdom

[73] Assignee: Rolls-Royce plc, London, United Kingdom

[21] Appl. No.: 09/313,991

[22] Filed: May 19, 1999

[30] Foreign Application Priority Data

May 30, 1998 [GB] United Kingdom ..... 9811577

[51] Int. Cl.[7] ..... F02C 1/00

[52] U.S. Cl. ..... 60/740; 60/742; 60/748

[58] Field of Search ..... 60/742, 748

[56] References Cited

U.S. PATENT DOCUMENTS 4,713,938 12/1987 Willis .

4,893,475 1/1990 Willis .

6,076,356 5/2000 Pelletier ..... 60/740

*Primary Examiner*—Timothy S. Thorpe

*Assistant Examiner*—William Rodriguez

*Attorney, Agent, or Firm*—W. Warren Taltavull; Farkas & Manelli PLLC

[57] ABSTRACT

A fuel injector (32) for a gas turbine engine combustion chamber (22) comprises a fuel injector nozzle (34) and a fuel feeding member (36). A wire mesh (76) is located in a space (74) defined between a hollow outer member (72) arranged around and spaced from a hollow inner member (70) of the fuel feeding member (36) and a fuel nozzle body (54) of the fuel injector nozzle (34). The wire mesh (76) rubs against the hollow outer member (72), the hollow inner member (70) and the fuel nozzle body (54) to frictionally damp vibrations of the fuel injector (32).

12 Claims, 2 Drawing Sheets

FUEL INJECTOR

The present invention relates generally to a fuel injector, particularly to a fuel injector for a gas turbine engine combustion chamber.

A problem associated with fuel injectors used in the combustion chambers of gas turbine engines is that of vibration. In some instances the amplitude of vibration of the fuel injectors, during operation of the gas turbine engine, may be sufficient to cause damage to the fuel injectors.

Accordingly the present invention seeks to provide a fuel injector which reduces the above mentioned problem.

Accordingly the present invention provides a fuel injector for a combustion chamber comprising a fuel injector nozzle and a fuel feeding member, the fuel injector nozzle being arranged at a first end of the fuel feeding member and attachment means being arranged at a second end of the fuel feeding member to connect the fuel injector to the combustion chamber, the fuel feeding member having at least one passage for the supply of fuel to the fuel injector nozzle, a hollow member arranged around and spaced from at least one of the fuel injector nozzle and the fuel feeding member and a wire mesh arranged in the space between the hollow member and at least one of the fuel injector nozzle and the fuel feeding member, the wire mesh being arranged to contact the outer surface of at least one of the fuel injector nozzle and the fuel feeding member and the inner surface of the hollow member to damp vibrations of the fuel injector.

Preferably the hollow member is arranged around and spaced from the fuel injector nozzle and is arranged around and spaced from the fuel feeding member. Preferably the wire mesh extends the full length cf the fuel feeding member between the fuel injector nozzle and the attachment means.

Preferably the wire mesh is a knitted wire mesh or woven wire mesh. Preferably the wire mesh is a single piece of woven wire mesh. Preferably the fuel feeding member and the hollow member are circular in cross-section at least in part of their lengths. Preferably the wire mesh is a single annular piece of woven wire mesh. Preferably the wire mesh is woven into a sock.

Preferably the fuel injector nozzle comprises an airspray fuel injector.

Preferably the wire mesh is secured to at least one of the fuel feeding member and the fuel injector nozzle or the outer member, by spot welding at a plurality of locations.

The present invention will be more fully described by way of example with reference to the accompanying drawing, in which.

Figure 1:
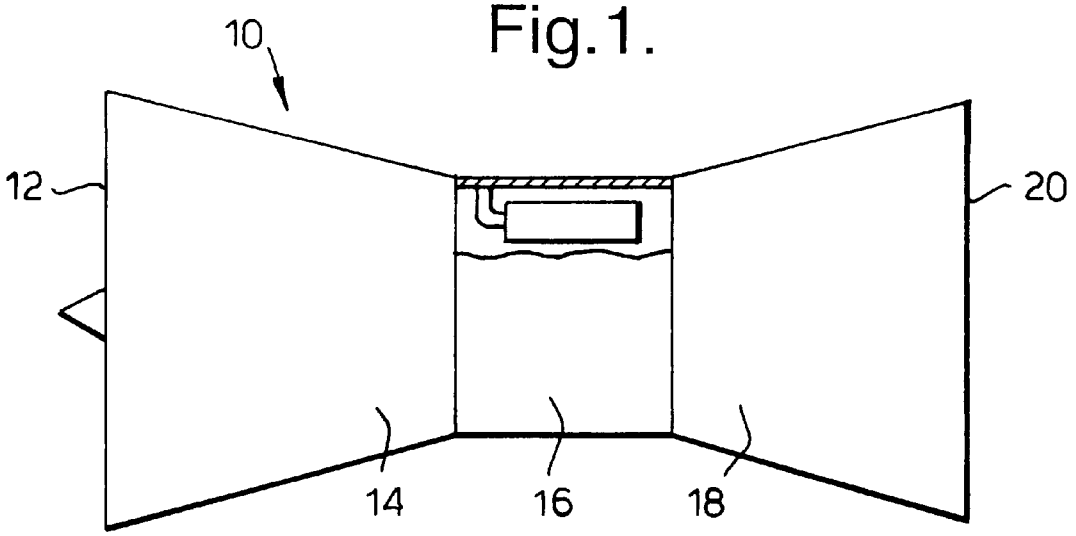
FIG. 1 is a view of a gas turbine engine showing a combustion chamber having a fuel injector according to the present invention.

A gas turbine engine 10, shown in FIG. 1, comprises i axial flow series an inlet 12, a compressor section 14, a combustion chamber assembly 16, a turbine section 18 and an exhaust 20. The turbine section 18 may comprise one or more turbines and the compressor section 14 may comprise one or more compressors, e.g. low and high pressure compressors and low and high pressure turbines. The turbine section 18 is arranged to drive the compressor section 14 via one or more shafts (not shown). The operation of the gas turbine engine is quite conventional and will not be discussed further.

Figure 2:
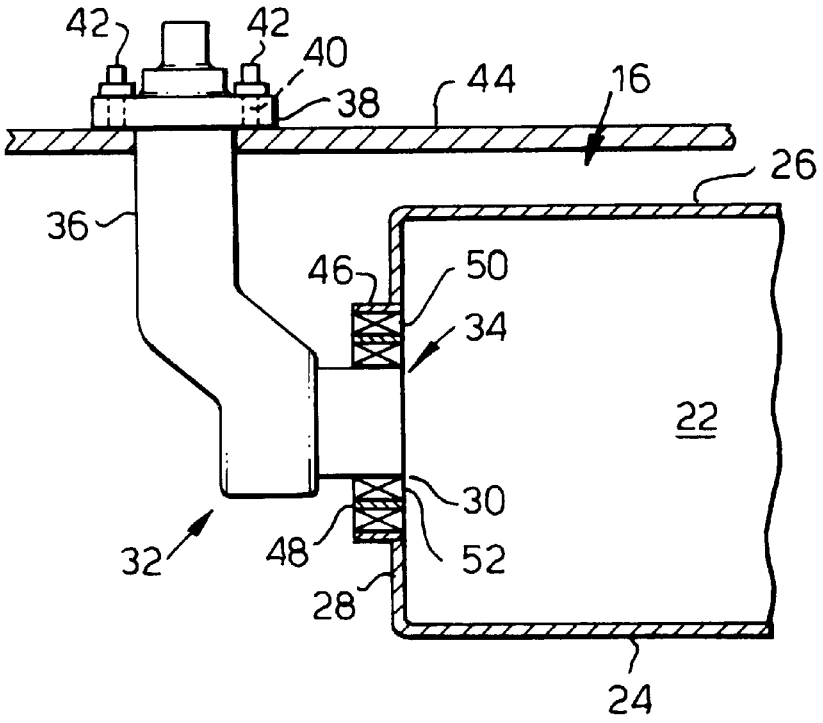
FIG. 2 is an enlarged longitudinal cross-sectional view through the combustion chamber shown in FIG. 1.
Figure 3:
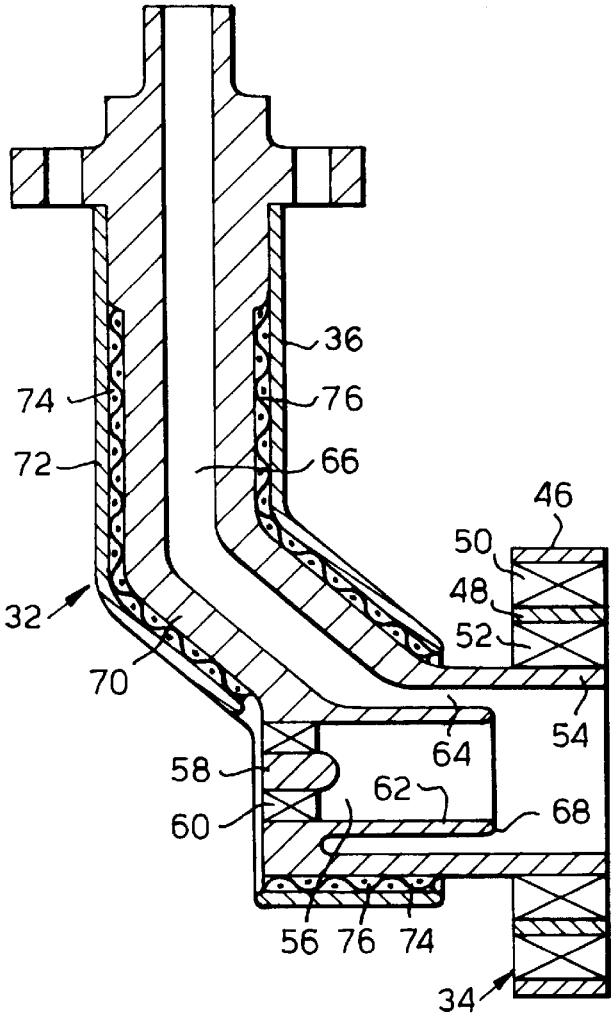
FIG. 3 is an enlarged longitudinal cross-sectional view through the fuel injector shown in FIG. 2.
Figure 4:
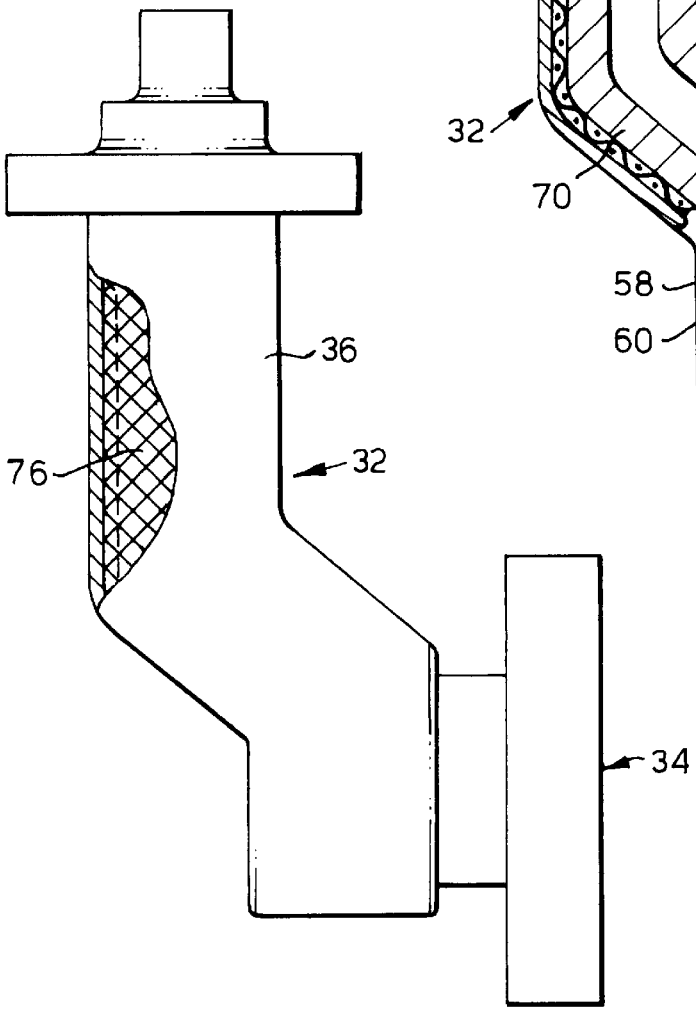
FIG. 4 is a partially cut-away view through the fuel injector shown in FIG. 3.

The combustion chamber assembly 16 is shown more clearly in FIG. 2. The combustion chamber assembly 16 comprises an annular combustion chamber 22. The combustion chamber 22 comprises an inner annular wall 24, an outer annular wall 26 and an annular upstream wall 28 which extends radially between the upstream ends of the first and second annular walls 24 and 26 respectively.

The annular upstream wall 28 of the combustion chamber 22 has a plurality of equi-circumferentially spaced apertures 30 to allow the supply of air and fuel into the combustion chamber 22. A plurality of fuel injectors 32 are provided and each fuel injector 32 is associated with a respective one of the apertures 30 in the upstream wall 28 of the combustion chamber 22.

Each fuel injector 32 comprises a fuel injector nozzle 34 and a fuel feeding member 36. The fuel injector nozzle 34 is arranged to locate in the respective aperture 30 in the upstream wall 28 of the combustion chamber 22. The fuel injector nozzle 34 is arranged at one end of the fuel feeding member 36 and a boss 38 is arranged at the other end of the fuel feeding member 36. The boss 38 is provided with apertures 40 through which bolts 42 pass in order to connect the fuel injector 32 to the combustion chamber casing 44.

The fuel injector nozzle 34 comprises an outer cylindrical wall 46, an inner cylindrical wall 48, a first set of swirl vanes 50 extend radially between the outer and inner cylindrical walls 46 and 48 respectively and a second set of swirl vanes 52 extend radially between the inner cylindrical wall 48 and the fuel injector nozzle body 54. The swirl vanes 52 form an inner air swirler and the swirl vanes 50 form an outer air swirler. The first and second sets of swirl vanes 50 and 52 are arranged to swirl the air in opposite directions.

The fuel injector nozzle body 54 has a circular cross-section passage 56 which extends coaxially therethrough. A central body 58 is positioned coaxially in the passage 56 at the upstream end of the fuel injector nozzle body 54 and a third set of swirl vanes 60 extend radially between the central body 58 and the fuel injector nozzle body 54. An annular lip 62 extends coaxially, in a downstream direction from the third set of swirl vanes 60 and an annular chamber 64 is defined between the annular lip 62 and the inner surface of the fuel injector nozzle body 54. A passage 66 extends through the fuel feed arm 36 to the annular chamber 64 to supply fuel to the annular chamber 64. The annular lip 64 has a downstream end 68.

The fuel feeding member 36 comprises a hollow inner member 70 and the passage 66 extends longitudinally through the hollow inner member 70 to the fuel injector nozzle 34.

A hollow outer member 72 is arranged around the hollow inner member 70 of the fuel feeding member 36 and is spaced from the hollow inner member 70 to define a chamber 74. At least one wire mesh 76 is located in the chamber 74 and the wire mesh 76 is arranged such that at least some of it's outer surface contacts the inner surface of the hollow outer member 72 and at least some of it's inner surface contacts the outer surface of the hollow inner member 70. The hollow inner member 70 of the fuel feeding member 36 and the hollow outer member 72 have circular cross-sections at least in part of their lengths.

The hollow outer member 72 is also arranged around the fuel injector nozzle body 54 of the fuel injector nozzle 34 and is spaced from the from the fuel injector nozzle body 54 to define a chamber 74. At least one wire mesh 76 is located in the chamber 74 and the wire mesh 76 is arranged such that at least some of it's outer surface contacts the inner surface of the hollow outer member 72 and at least some of it's inner surface contacts the outer surface of the fuel injector nozzle body 54. The hollow outer member 72 and the fuel injector nozzle body 54 of the of the fuel injector nozzle 34 have circular cross-sections at least in part of their lengths.

In operation any vibrations of the fuel injector 32 are damped by the frictional contact between the wire mesh 76 and the hollow inner member 70, between the wire mesh 76 and the fuel injector nozzle body 54 and between the wire mesh 76 and the hollow outer member 72. The wire mesh 76 has shown the potential to reduce the amplitude of vibration of the fuel injector 32 by a factor of ten.

The wire mesh is preferably a woven wire mesh or knitted wire mesh and preferably the wire mesh is cut into large pieces to minimise the possibility of loss of the wire mesh pieces from the fuel injector. The wire mesh is preferably a knitted wire mesh in the form of a sock. It is preferred that as much wire mesh as possible is placed in the chamber to increase the number of contact areas between the wire mesh and the hollow inner member and between the wire mesh and the hollow outer member. It is preferred that the wire mesh is secured to any one or more of the hollow outer member, the hollow inner member and the fuel injector nozzle body by micro-spot welding at small number of suitable locations. Alternatively the wire mesh may be secured to the hollow inner member or the fuel injector nozzle body by wrapping a wire around the wire mesh. The wire mesh is manufactured from a suitable metal or alloy for example a superalloy.

The advantages of the use of the wire mesh is that it damps the amplitude of vibration of the fuel injector, there is no need to modify the design of the fuel injector, there is only a small increase in mass of the fuel injector due to the wire mesh, the wire mesh does riot wear away with use due to its compliant nature.

Although an airspray fuel injector has been shown it may be possible to vapourising, or other types of fuel injector, providing that the fuel feeding member of the fuel injector has inner and outer members separated by a space.

Although the invention has been described as having an outer hollow member and wire mesh around the fuel feeding member and the fuel injector nozzle it may be possible to provide the hollow member and wire mesh around only the fuel feeding member or around only the fuel injector nozzle. Although the invention has been described as having the wire mesh extending the full length of the fuel feeding member between the boss and the fuel injector nozzle, it may be possible for the wish mesh to extend only part of the length of the fuel feeding member between the boss and the fuel injector nozzle. Although the invention has been described as having the wire mesh extending only part of the length of the fuel injector nozzle, it may be possible for the wire mesh to extend the full length of the fuel injector nozzle.

I claim:

1. A fuel injector for a combustion chamber comprising a fuel injector nozzle and a fuel feeding member, the fuel injector nozzle being arranged at a first end of the fuel feeding member and attachment means being arranged at a second end of the fuel feeding member to connect the fuel injector to the combustion chamber, the fuel feeding member having at least one passage for the supply of fuel to the fuel injector nozzle, a hollow member arranged around and spaced from at least one of the fuel injector nozzle and the fuel feeding member and a wire mesh arranged in the space between the hollow member and at least one of the fuel injector nozzle and the fuel feeding member, the wire mesh being arranged to contact the outer surface of at least one of the fuel injector nozzle and the fuel feeding member and the inner surface of the hollow member to damp vibrations of the fuel injector.

2. A fuel injector as claimed in claim 1 wherein the hollow member is arranged around and spaced from the fuel injector nozzle and is arranged around and spaced from the fuel feeding member.

3. A fuel injector as claimed in claim 1 wherein the wire mesh extends the full length of the fuel feeding member between the fuel injector nozzle and the attachment means.

4. A fuel injector as claimed in claim 1 wherein the wire mesh is a knitted wire mesh.

5. A fuel injector as claimed in claim 1 wherein the wire mesh is a single piece of woven wire mesh.

6. A fuel injector as claimed in claim 1 wherein the fuel feeding member and the hollow member are circular in cross-section at least in part of their lengths.

7. A fuel injector as claimed in claim 6 wherein the wire mesh is a single annular piece of woven wire mesh.

8. A fuel injector as claimed in claim 7 wherein the wire mesh is woven into a sock.

9. A fuel injector as claimed in claim 1 wherein the fuel injector nozzle comprises an airspray fuel injector.

10. A fuel injector as claimed in claim 1 wherein the wire mesh is secured to at least one of the fuel feeding member, the fuel injector nozzle and the outer member, by spot welding at a plurality of locations.

11. A gas turbine combustion chamber comprising a fuel injector as claimed in claim 1.

12. A fuel injector as claimed in claim 1 wherein the wire mesh is a woven wire mesh.

* * * * *